United States Patent [19]

Mueller

[11] 3,948,388

[45] Apr. 6, 1976

[54] FRAME-LIKE HOLDER FOR ARTICLES

[75] Inventor: David Charles Mueller, Neenah, Wis.

[73] Assignee: American Can Company, Greenwich, Conn.

[22] Filed: Jan. 25, 1971

[21] Appl. No.: 109,221

[52] U.S. Cl. ..... 206/192; 206/194; 206/196

[51] Int. Cl.[2] ..... B65D 67/00

[58] Field of Search ..... 229/40, 6, DIG. 4; 220/116; 206/65 R, 65 C, 153, 152, 429, 192, 196, 194; 294/87.2

[56] References Cited

UNITED STATES PATENTS

| | | | |
|---|---|---|---|
| 1,081,724 | 12/1913 | DeSmith | 229/DIG. 4 |
| 2,377,602 | 6/1945 | Belden | 206/418 |
| 2,982,399 | 5/1961 | Fisher | 206/65 C |
| 2,986,272 | 5/1961 | Kruse | 206/65 C |
| 3,098,583 | 7/1963 | Sherman et al. | 229/40 X |
| 3,108,690 | 10/1963 | Dunn | 206/65 C |
| 3,128,034 | 4/1964 | Weiss | 206/152 X |
| 3,146,885 | 9/1964 | Hughes | 206/65 C |
| 3,166,190 | 1/1965 | Conrades | 206/65 C |
| 3,170,570 | 2/1965 | Rice | 206/153 |
| 3,281,180 | 10/1966 | Spery | 206/153 X |
| 3,298,513 | 1/1967 | Krooss et al. | 229/40 X |
| 3,604,614 | 9/1971 | Sternfeld | 229/40 |

*Primary Examiner*—Leonard Summer
*Attorney, Agent, or Firm*—Robert P. Auber; Paul R. Audet; George P. Ziehmer

[57] ABSTRACT

A composite frame-like holder for a plurality of articles such as containers, a blank for the composite holder, and a method of forming the holder from the blank. The composite holder is an aggregate of singly or multiply severable holder units which can be severed from the composite in a manner that maintains the integrity of the severed unit and of the remaining composite. Each unit has a sloping leg panel with an aperture for receiving an article, a vertical side panel and a top panel foldable over the article and having means adjacent its edge for securing it to the holder unit. The method includes folding the blank along its center line to place its sections in superimposed, substantially mirror-image juxtaposition, securing one section to the other along their center strips, severing the center line, depositing containers in leg panel apertures and securing the containers to the thereby formed holders.

7 Claims, 11 Drawing Figures

INVENTOR.
DAVID CHARLES MUELLER
BY
Leonard R. Johan
ATTORNEY

INVENTOR.
DAVID CHARLES MUELLER
BY
Leonard R. Kohan
ATTORNEY

FRAME-LIKE HOLDER FOR ARTICLES

This invention relates to a holder for carrying articles. More particularly, it relates to a composite frame-like holder for carrying a plurality of containers or the like. The invention also relates to a blank of foldable sheet material and a method of manipulating the blank to form the U-shaped, composite frame-like holder.

Providing compact, handy, multiple packages for a plurality of articles is well known. In present day mass merchandising, multiple packaging has been applied to a variety of articles, especially containers of goods such as beverages. The packages are often specifically designed to fit the nature of the containers and/or the goods therein contained.

Recently, multiple packaging has been applied in a new area, that is, in relation to medicine and pharmaceuticals wherein the trend is toward unit dosages. Pharmaceutical companies, hospitals and doctors are now seeking to minimize chances of patients taking improper dosages of often potentially harmful medicines by providing patients with medicines and drugs, e.g., those in liquid or granular form, in pre-measured, individually-contained, single or unit dosages. With this trend toward individually-contained unit dosages, there has arisen a new need for compact, multiple packages specially designed to house unit dose containers. The composite frame-like holder package of this invention meets this need by being an aggregate of individual holder unit packages, one for every unit dose container. Each holder unit is a substantially U-shaped frame-like package and is integrally but severably connected other holder units to form a composite frame-like holder. The units are easily severable from the composite and from each other along lines of weakness in a manner that allows one or more units in single or multiple subcomposite combinations, to be easily removed from the main package without destroying the integrity of the severed units or the main and allows the units to be easily dispensed to patients in such numbers and combinations as needed. The compartmentalized, composite package of U-shaped frame-like holders is advantageous because each container is protected against abuse and its contents against contamination; the package minimizes dosage errors, reduces waste, and saves the labor of pharmacists, nurses and doctors by providing compact, standardized, easily stored, handled and dispensed composite unit dose packages. Important printed information as to contents and dosage directions can be placed on the top panels of each holder unit so that the information is readily visible and available when the units are separated from the composite package.

The blank of this invention and the method of manipulating and filling it to form the hereinabove described composite frame-like holder package, are advantageous because they reduce packaging costs by being especially suited for conventional, automated, continuous straight-line packaging systems.

BRIEF SUMMARY OF THE INVENTION

The basic, substantially U-shaped frame-like holder of this invention is a single holder unit for holding an article such as a container. A holder unit comprises a top panel, a leg panel and a side panel therebetween. The top panel overlies an article such as a container disposed within an aperture in the leg panel. The top panel includes means for securing the article to the holder and can include an integral flange panel defined by means allowing it to extend downwardly over an edge of the article. The leg panel slopes diagonally downward from and has its aperture positioned away from the side panel. In a preferred version of the holder unit, the securing means is a knife cut adjacent the junction of the top panel and its flange panel for accommodating an edge of an article, e.g. the lip of a container, and the flange panel includes a vertical L-shaped knife cut allowing the holder to accommodate articles such as containers having flanges of varying thicknesses.

A composite frame-like holder for articles such as containers comprising two sections, each being an individual substantially U-shaped basic holder unit, can be formed from the blank of this invention according to the method of this invention. The sections, here also meaning units, are vertically, oppositely and continuously adhesivedly affixed to each other along the entire horizontal length of their center strips, i.e. the length of the unit side panels, to form a conjoining, continuously affixed, vertically-standing, horizontally-extending interiorly-severable center beam for the composite. The side panels of each unit are defined by lines of weakness which can be score lines on one unit and cut score lines on the other unit.

Each section of the composite frame-line holder can be comprised of integral rows of a plurality of the basic, substantially U-shaped holder units. The units are defined by severing means such as perforated lines running on the top and leg panels from their adjoining inner side panels to adjacent the outer edges of the top and leg panels. The perforated lines allow one or more holder units to be singly or multiply severed from the composite holder in a manner that maintains the integrity of the units and that of the remaining aggregate.

The blank of this invention is of foldable sheet material adapted to be formed into a composite frame-like holder for articles such as containers. The blank has two sections defined by a severable, perforated center line therebetween. Each section is comprised of at least one holder unit. Each unit has a leg panel with an aperture for receiving an article such as a container or the like, a top panel adapted to be an overlying protective cover for the article and a center strip adapted to form an inner vertical side panel for each section. Either the top panel or the leg panel can be located adjacent to the perforated center line. The center strip is defined by weakness lines, e.g. score lines and cut score lines between the top and leg panels and is an area wherein the sections can be severably secured to one another when the blank is folded along the center line in a manner that renders the sections in overlyingly-proximate, substantially mirror-image relationship. The top panel has means to secure the container to the holder unit, and it can include an integral flange panel adaptable to be folded into abutting relationship with a container. Knife cuts can be placed at the junction of these panels and the flange panel can include means such as vertical knife cuts to provide flexibility for accommodating containers having flanges of varying thicknesses. Each section of the blank can include a plurality of such holder units and when the sections do, the blank is adaptable to form the composite frame-like holder of this invention. Units of each section of the composite are defined by weakness lines vertical to the center line. The weakness lines are adapted to allow one or more of the holder units of the to-be-formed composite package to be removed from the package without destroying the integrity of the removed units or of the remaining aggregate.

The method of this invention for forming the composite frame-like holder package from the hereinabove described blank comprises folding the sections along the center line to render the sections in overlyingly-proximate, substantially mirror-image relationship, securing, as with an adherent, the center strips of each section to one another, severing the perforated center line, making the leg panels vulnerable to receive articles, depositing the articles therein, folding the top panels over the containers and securing the containers to the units of the composite holder. The order of the steps of severing of the center line and securing the center strips can be reversed.

DETAILED DESCRIPTION OF THE INVENTION

Figure 1:
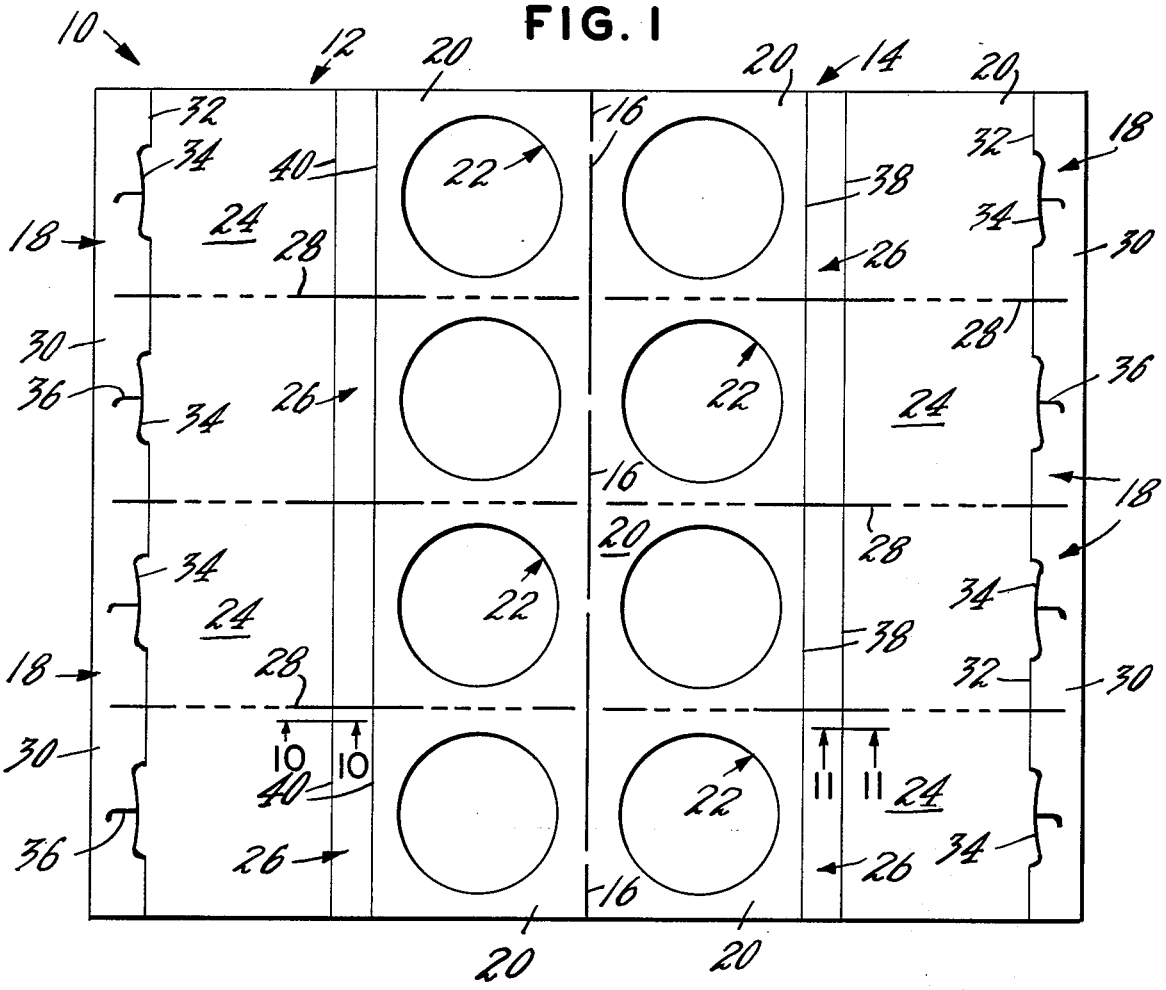
FIG. 1 is a plan view of the blank of sheet material adaptable to be formed into a composite frame-like holder in accordance with this invention.

Referring now to FIG. 1, there is illustrated a blank 10 for forming the composite holder of this invention. The blank has two sections 12 and 14 defined by a severable perforated center line 16 therebetween. The perforated center line can include elongated knife cuts, as shown, to facilitate severance of the section during manipulation of the blank according to the method of this invention. Each section comprises a plurality of integral holder units 18, each unit having a leg panel 20 with an aperture 22 for receiving articles therein, a top panel 24 and a center strip 26 integrally therebetween. Defining the units are interstitial, horizontal, perforated lines 28 running vertically from adjacent center line 16 through leg panels 20 and center strips 26 to adjacent the outer edges of top panels 24. Top panels 24 can have integral flange panels 20 adjacent their outer portions, the flange panels being defined by score lines 32 running substantially parallel to center line 16 and lines of weakness 38 and 40. Arcuate knife cuts 34 break the continuity of score lines 32 and are adaptable for engaging lip-like protruding edges (48 in FIGS. 4-9) of containers and thereby securing the containers to the holder units. L-shaped knife cuts 36, running vertically into knife cuts 34 from adjacent the edges of flange panels 30, provide tearing areas to facilitate removal of containers from holder units. The cuts also provide flexibility to the holder so that it can accommodate containers having flanges of varying thicknesses. Center strips 26 of each section form an inner side panel for each unit or row of units of each section, and are areas wherein the individual unit or rows of units can be severably secured to one another when the sections are folded along their center line and are thereby rendered in overlyingly, substantially mirror-image relationship. Center strips 26 are defined by lines of weakness 38 and 40 running substantially parallel to each other, to center line 16 and to lines of weakness 32. Lines of weakness 38 and 40 can be of various types which render the units easily severable from each other after they are adjoined along their side panel center strips. It has been found convenient to provide one set of weakness lines, e.g. 38, as mere score lines and the other, e.g. 40, as cut score lines. Providing one weaker set or combination of lines such as cut score or perforated lines facilitates severance of the units one from another along their side panels. It has been found that when weakness lines are provided in this manner, severance occurs by ply separation within the side panel material itself rather than as for example by severance within an adhesive layer provided between the side panels. The apertures of leg panels 20 can be of any size or shape depending on the nature of the article to be therein contained. Apertures 22 are positioned away from side panels 26; that is, no portion of apertures 22 extends beyond the confines of leg panels 20, for example, they do not extend into side panels 26. The blank is equally adaptable to form the composite holder of this invention when the outer edge of top panel 24, e.g. the outer edges of integral flange panels 30, are adjacent center line 16, and leg panels 20 are in the place of top panels 24. The means for securing containers to holder units adjacent edges of top panels 24 need not be knife cuts but can be other means such as adhesive strips, tape or cooperating locking or fastening means. Blanks within the scope of this invention need not comprise the number of units as shown in FIG. 1 but may range from only one unit per section, to any number of units per section. The blanks can be made of paperboard or other suitable, manipulable and severable material.

Figure 2:
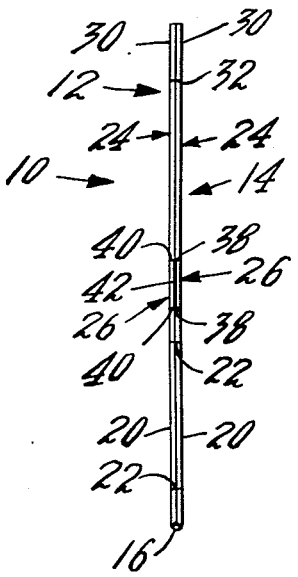
FIG. 2 is an end view of a vertically standing blank folded along its center line, whose sections are adhered at their center strip in overlyingly-proximate, substantially mirror-image relationship.

FIGS. 2 through 5 are illustrations showing the steps involved in the method of manipulating blank 10 of FIG. 1 to form the U-shaped frame-like containr of this invention. FIG. 2 shows and end view of a vertically-standing blank 10 folded along its center lne 16 so that sections 12 and 14 are in overlyingly-proximate, substantially mirror-image relationship. Sections 12 and 14 are severably secured to one another at their center strips as by an adhesive 42 which can be previously applied to one or both of the center strips. Although it has been found advantageous to use an adhesive, the center strips can be secured by other means such as tapes, adhesive strips or interlocking or fastening means. Also shown in FIG. 2 are flanges 30 of top panels 24, apertures 22 of leg panels 20 and lines of weakness 32, 38 and 40.

Figure 3:
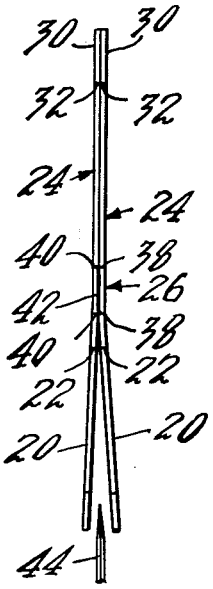
FIG. 3 is another end view of the blank severed along its center line to thereby separate the leg panels of its sections.

FIG. 3 shows the folded blank of FIG. 2 after its leg panels 20 have been severed and separated along center line 16 by means such as blade or wedge 44. Severance of center line 16 can be performed prior or subsequent to securing center strips 26 to each other, though the latter procedure has proved more convenient.

Figure 4:
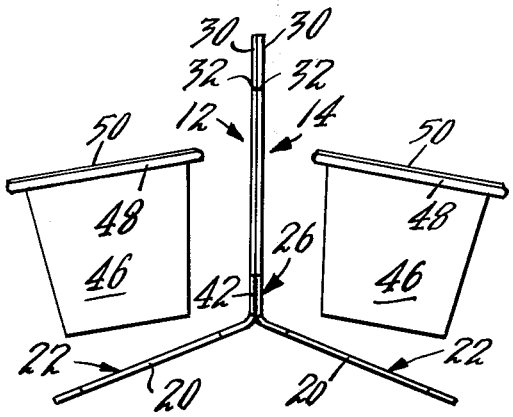
FIG. 4 shows containers about to be deposited within the apertures of the separated leg panels.

FIG. 4 shows a wider angle of separation between leg panels 20, the legs thereby being rendered vulnerable to receive articles such as containers 46 having bottom-tapered circumferences, protruding lip-like edges 48 and laminated lids such as peelable paper, foil or laminate covers 50.

Figure 5:
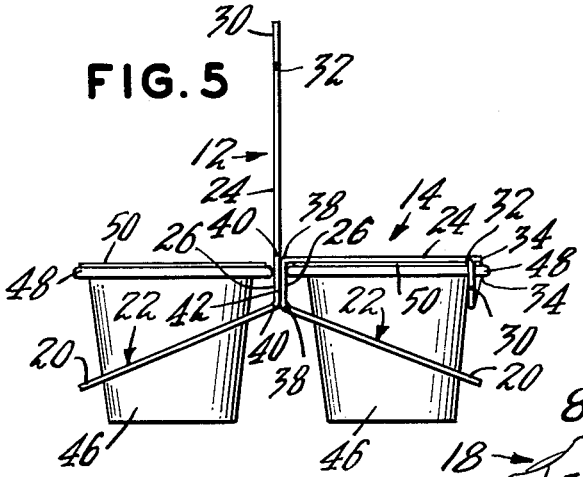
FIG. 5 shows containers deposited within the leg panel apertures.

FIG. 5 shows containers 46 deposited within apertures 22 of the sloping leg panels 20 of sections 12 and 14. The right hand portion of FIG. 5, section 14, shows the basic, substantial U-shape of the frame-like holder obtained by the geometry of folded top panel 24, side panel 26 and leg panel 20. Top panel 24 of blank section 14, is shown folded adjacent score line 38 and lying as a protective cover over container 46. The panel is also shown having flange panel 30 folded along score line 32 so that the flange is substantially vertical with and proximous to the sides of container 46 and so that securing means such as knife cuts 34 provide a means for securing the container to the holder as by engaging its protruding lip-like edges 48. FIG. 5 also shows center strips 26 secured by adhesive 42 and forming side panels for the respective holder units of sections 12 and 14.

Thus, as illustrated in FIGS. 2 through 5, the method of this invention comprises folding blank 10 along its center line 16 so that sections 12 and 14, specifically, e.g. center strips 26 and apertures 22, are rendered in overlyingly-proximate, substantially mirror-image relationship, securing center strips 26 of sections 12 and 14 to one another with means such as adhesive 42, severing center line 16, spreading the leg panels 20 of each section to thereby render apertures 22 vulnerable to receive containers 46, depositing the containers in apertures 22, folding top panels 20 and flange panels 30 of each section over the containers, and securing the containers to the holder units and composite holder by utilizing securing means such as knife cuts 34 in top panels 20. Each step in the above method can be effected by currently available automated systems. For example, large, suitable stock sheet materials such as paperboard can be conventionally die cut into sheets containing a multitude of integral blanks which can then be separated between flange panels 30 into rows of integral, end-to-end blanks having aligned panels, apertures and center strips. These rows can be readily and continuously straight-line processed and loaded, for example, by continuously passing one or both of their end-to-end aligned strips under an adhesive applicator, passing the substantially mirror-image rows through folders, wedges which sever center line 16 and separate the leg panel, loaders and folders and securers which fold the top and flange panels over and secure the containers within the rows of frame-like holders. The rows can, at any convenient time, be dissected along perforated score lines 28 into composite holders of say about ten units, (five in each row).

Figure 6:
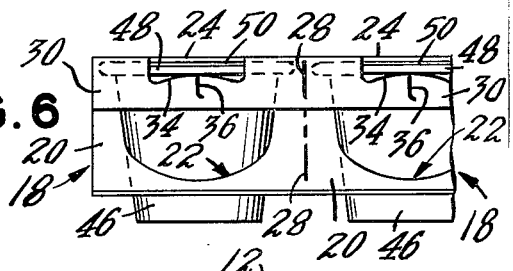
FIG. 6 is a side view of an end portion of a section of the composite holder.

FIG. 6 is a side view of a holder unit 18 and a portion of another defined by perforated score lines 28 adjacent the edges of flange panels 30 of top panels 24, and the edges of leg panels 20 which extend in a sloping, substantially diagonally downward direction from side panels 26. The figure shows containers 46 in apertures 22 of sloped legs 20 and shows the containers' lip-like edges 48 and overlying foil covers 50 protruding through knife cuts 34 in top panels 24 and in flange panels 30. The arcuate shape of knife cuts 34 provides some underlying support for lip-like edge 48. Vertical, L-shaped knife cuts 36 are shown running into the arcuate edges of knife cuts 34.

Figure 7:
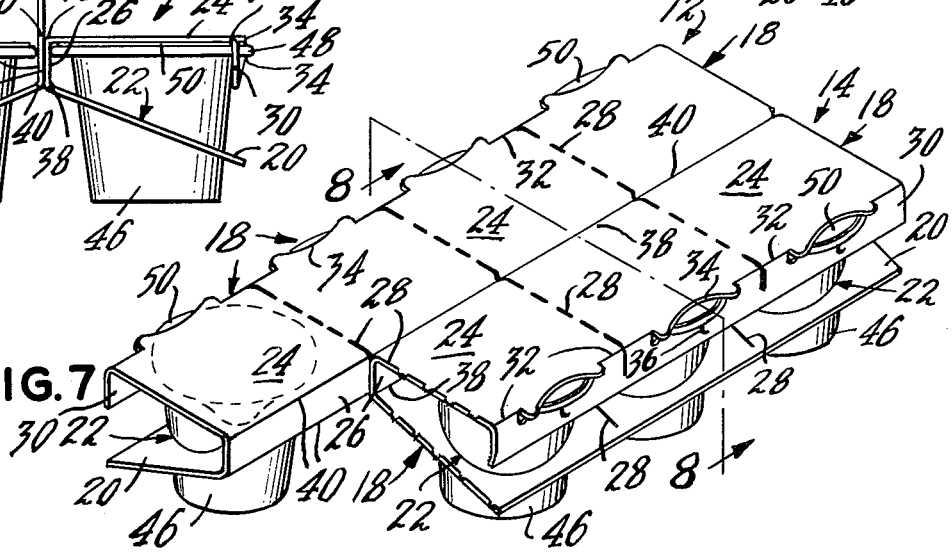
FIG. 7 is a perspective view of the composite holder, one of its holder units having been removed.

FIG. 7 is a perspective view of the novel, composite frame-like holder of this invention made from blank 10 according to the hereinabove described method. Therein illustrated are two integral parallel rows of four and three holder units, each row being vertically, oppositely and continuously adhesivedly affixed or secured to one another along their entire horizontal length integral center strips 26 which, as previously mentioned, form side walls for each holder unit 18 and, when severably secured together, form a conjoining continuously affixed, vertically-standing, horizontally-extending, interiorly-severable center beam running the length of the composite holder. FIG. 7 shows the integral composite holder after one of its holder units (shown in FIG. 9) has been removed therefrom along severing means, such as perforated lines 28 in top panel 24, and along cut score lines 40. Score lines defining the center strip or side panel of one section, and cut score lines along that of the other section, make it relatively easy to effect severance by ply separation within and through the side wall material in which the cut score lines are placed. When severance is effected in this manner the severed top layer of side wall material remains with the adherent and is removed along with the opposing unit. This method of separating units from each other has been found advantageous since it requires little effort and provides a neat severance. It also has been found easier than trying to obtain a severance within the adhesive material. Score lines 28 and weakness lines 38 and 40 thus allow one or more units to be neatly and easily severed from each other and removed from the composite holder without destroying the integrity of the remaining aggregate holder.

Figure 8:
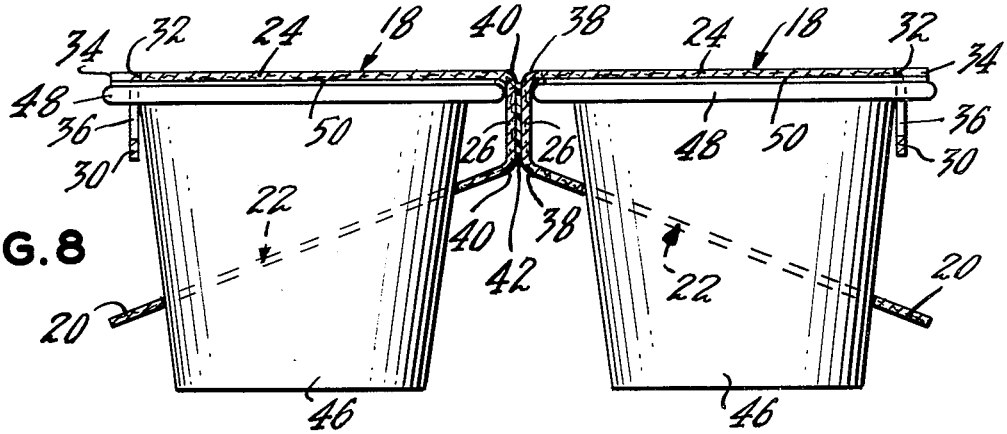
FIG. 8 is a cross sectional view taken along line 8—8 of the composite holder of FIG. 7.

FIG. 8 is a cross-sectional view taken along lines 8—8 of FIG. 7, and shows two containers 46 secured within two U-shaped frame-like holder units severably secured to one another by adhesive 42 at their center strips or side walls 26. Lines 8—8 are taken through L-shaped knife cuts 36.

Figure 9:
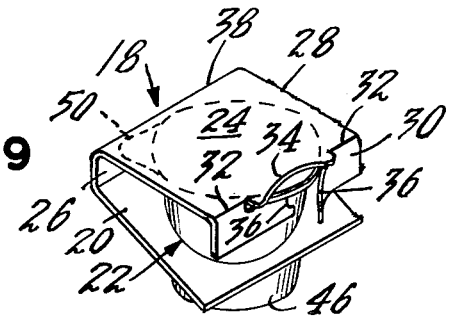
FIG. 9 is a perspective view of a substantially U-shaped holder unit removed from the holder of FIG. 7.

FIG. 9 shows a single U-shaped frame-like holder unit 18 removed from the composite frame-like holder of FIG. 7 along the perforated lines 28 of top panels 24 and leg panels 20. FIG. 9 also illustrates a simple method of removing a container from the holder unit, i.e. by tearing the integral portion of flange panel 30 below the "L" of L-shaped knife cuts 36, lifting flange panel 30 around the axis of score line 32, lifting the flange and top panel 24 around the axis of line of weakness 38, and removing the container from aperture 22. An even simpler method is merely to swing flange panel 30 up around the axis of score line 32 to thereby disengage the lip-like edge 48 of container 46 from securing knife cut 34.

Figure 10:
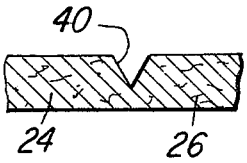
FIGS. 10 and 11 are enlarged vertical cross sections taken substantially along lines 10—10 and 11—11 of FIG. 1.
Figure 11:
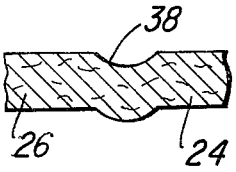

FIGS. 10 and 11 are enlarged vertical cross sections taken through lines 10—10 and 11—11 of FIG. 1, and respectively show the distinction between one of the cut score lines 40 and one of the score lines 38, the former being a cut into, and the latter a crease in, blank 10.

Thus, according to the invention disclosed herein, there is presented a simple, rapid and economical method of manipulating a blank to form a composite frame-like holder package of individual holder units each housing an individual article such as a unit dose container. The composite holder has been found advantageous because it is compact and is easy to handle and store, and, its holder units are readily removed therefrom in single or multiple combinations without destroying the integrity of the remaining composite package. Removal of one or more units from the composite can be easily and neatly effected by severance at the adhesive area between side panels or, as preferred, within the material of one of the side panels. The top panels of the holder units provide protection against container abuse and contamination of contents, and the uncomplicated manner in which articles are secured within holders renders them easily removable therefrom.

It is thought that the invention and many of its attendant advantages will be understood from the foregoing description, and it will be apparent that various changes may be made in the form, construction and arrangement of the parts without departing from the spirit and scope of the invention or sacrificing all of its material advantages, the forms hereinbefore described being merely a preferred embodiment thereof.

I claim:

1. A composite frame-like holder for articles such as containers, comprising:

two sections, each section being an integral row of a plurality of substantially U-shaped frame-like holder units, each of said units being for holding a single article therein, each unit having:

a top panel providing an overlying protective cover for the article, a leg panel having a free outer edge and an aperture for receiving the article and a side panel shorter than the axial length of said article, extending substantially vertically from said top panel and connecting said top panel to said leg panel, said side panel being defined by lines of weakness between said top and leg panels, said leg panels extending in a sloping, substantially diagonally downward direction from said side panel, and having its aperture positioned away from said side panel, each of said units of each rowed section being defined by severing means adjacent the edges of their respective adjoining unit panels, said edges running substantially vertical from adjacent said side panels to adjacent the said outer opposing edges of said other panels, each of said top panels of each section having, adjacent its edge opposite said side panel and adjacent the similarly opposing outer edge of said article, means for securing said article to said holder unit, said composite holder being formed by each side panel of each holder unit of one section being severably affixed along its horizontal length to a side panel of a holder unit of the other section, such that the severably affixed side panels form a severably affixed, substantially vertical, horizontally-extending integral centre beam and two integral parallel rows of holder units, the centre beam being severable within and through the interior of a portion or all of its length, such that one or more of said units of said parallel rows can be severed from each other and from said composite holder in a manner that maintains the integrity of the severed units and of the remaining composite holder.

2. The composite holder of claim 1 wherein the side panels are affixed to each other by means of an adhesive which allows severance of the center beam to occur within and through said adhesive rather than within and through a side panel.

3. The composite holder of claim 1 wherein said lines of weakness defining said side panel are score lines in said one section and cut score lines in said other section, wherein the side panels are affixed to each other by means of an adhesive, and said cut score lines cooperate with each other to allow severance of the centre beam to occur from cut score line to cut score line within and through the side wall material having the cut score lines.

4. The composite holder of claim 1 wherein said severing means are perforated lines.

5. The composite holder of claim 4 wherein said top panel of each said section includes a flange panel adjacent to and integral with the outer edge of said top panel and defined by means for allowing it to extend downwardly over an upper edge of said article.

6. The composite holder of claim 5 wherein said article has a lip-like protruding edge and said securing means is a knife cut adjacent the junction of said top and flange panels, for accommodating said edge to secure said article to said holder units.

7. The composite holder of claim 7 wherein the leg panel aperture is circular for accommodating circumferentially bottom-tapered containers.

* * * * *